US006699076B2

(12) United States Patent
Wing

(10) Patent No.: US 6,699,076 B2
(45) Date of Patent: Mar. 2, 2004

(54) CONNECTOR ASSEMBLY WITH METAL OXIDE VARISTOR

(75) Inventor: Allan J. Wing, Howell, MI (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/253,461

(22) Filed: Sep. 24, 2002

(65) Prior Publication Data

US 2003/0068926 A1 Apr. 10, 2003

Related U.S. Application Data

(60) Provisional application No. 60/328,776, filed on Oct. 9, 2001.

(51) Int. Cl.[7] ..... H01R 13/66; H01R 33/945

(52) U.S. Cl. ..... 439/620; 439/181

(58) Field of Search ..... 439/620, 181, 439/88, 79

(56) References Cited

U.S. PATENT DOCUMENTS 4,600,256 A * 7/1986 Anttila ..... 439/65
5,022,870 A * 6/1991 Sakamoto et al. ..... 439/608
5,139,442 A 8/1992 Sakamoto et al.
5,181,864 A 1/1993 Wakino et al.
5,224,878 A 7/1993 Lurie et al.
5,865,648 A 2/1999 Clyatt, III
6,059,608 A * 5/2000 Benes ..... 439/620
6,459,042 B1 * 10/2002 Stilianos et al. ..... 174/138 G
6,498,708 B2 * 12/2002 Schilloff et al. ..... 361/58
6,572,412 B2 * 6/2003 Beuther et al. ..... 439/620

OTHER PUBLICATIONS

International Search Report, dated Jan. 8, 2003.

* cited by examiner

*Primary Examiner*—Hae Moon Hyeon

(57) ABSTRACT

A connector assembly includes a metal oxide varistor that diverts current when system operating voltages exceed a predetermined voltage limit. The connector assembly is used to connect a printed circuit board to a vehicle device such as an airbag assembly, for example. The connector assembly includes a first connector that cooperates with the printed circuit board and a second connector that cooperates with the vehicle device. The metal oxide varistor is mounted within one of the first or second connector housing members. Mounting the metal oxide varistor directly within the connector assembly removes the metal oxide varistor from is traditional position on the printed circuit board and allows the overall size of the printed circuit board to be reduced.

17 Claims, 2 Drawing Sheets

CONNECTOR ASSEMBLY WITH METAL OXIDE VARISTOR

CROSS-REFERENCE TO RELATED APPLICATIONS

The application claims priority to U.S. Provisional Application No. 60/328,776, which was filed on Oct. 9, 2001.

BACKGROUND OF THE INVENTION

This invention relates to connector assembly for an electronic control unit that incorporates surge protection directly into a connector housing.

Electronic control units can be used in various vehicle applications to transmit signals to control vehicle devices such as an airbag assembly, for example. The electronic control unit includes a printed circuit board mounted within a housing. A connector assembly is used to electrically connect the printed circuit board to the respective vehicle device. A surge protection device is incorporated into the electronic control unit to divert extra current to ground when operating voltages exceed a predetermined voltage limit.

One example of a surge protection device is a metal oxide varistor (MOV). The MOV typically includes a piece of metal oxide material in the middle that is joined to a power line and a grounding line by a pair of semiconductors. Traditionally, the MOV is mounted directly to the printed circuit board. Mounting the MOV on the printed circuit board itself takes up valuable space that could be used for other components or which prevents the size of the printed circuit board from being reduced to be used in applications requiring smaller electronic control unit modules.

Thus, it is desirable to have an electronic control unit that includes surge protection without requiring a surge protection device to be incorporated into the printed circuit board itself, as well as overcoming the other above-mentioned deficiencies with the prior art.

SUMMARY OF THE INVENTION

A connector assembly for an electronic control unit includes a metal oxide varistor (MOV) that diverts current when system operating voltages exceed a predetermined voltage limit. The MOV is directly incorporated into the connector assembly to reduce the size of an associated printed circuit board.

In one disclosed embodiment, the connector assembly is used to connect the printed circuit board to a vehicle device. The connector assembly includes a first connector that cooperates with the printed circuit board and a second connector that cooperates with the vehicle device. The MOV is mounted within one of the first or second connector housing members.

Preferably, the connector housing has a mount interface that includes a pair of holes. The MOV has a central body portion with a pair of transversely extending legs. The legs are received within the holes to directly connect the MOV to the connector housing. The connector assembly and MOV are soldered together to establish a secure connection for the assembly.

The subject system and method incorporates the MOV into the connector assembly for an electronic control unit to increase space on the associated printed circuit board for other components, or optionally, allow the size of the printed circuit board to be reduced. These and other features of the present invention can be best understood from the following specifications and drawings, the following of which is a brief description.

DETAILED DESCRIPTION OF A PREFERRED EMBODIMENT

Figure 1:
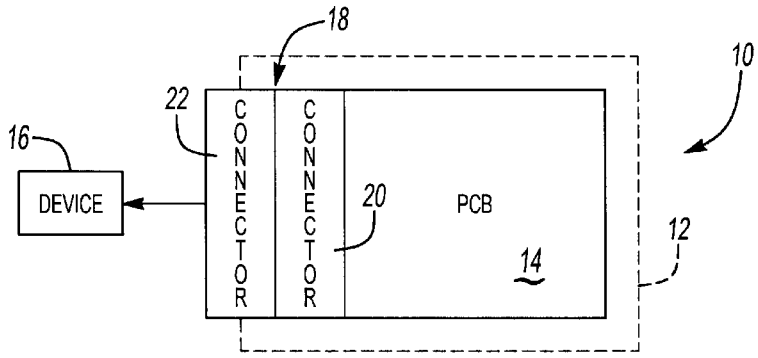
FIG. 1 is a schematic diagram of an electric control unit for controlling a vehicle device, which incorporates the subject invention.

An electronic control unit (ECU) is shown generally at 10 in FIG. 1. The ECU 10 includes a housing 12 that encloses a printed circuit board (PCB) 14 as known. The ECU 10 is preferably connected to a vehicle device 16, such as an airbag assembly for example, with a connector assembly 18.

The connector assembly 18 includes a first connector 20 operably associated with the PCB 14 and a second connector 22 operably associated with the vehicle device 16. The first 20 and second 22 connectors are mated together to electrically connect the ECU 10 to the vehicle device 16.

Figure 2:
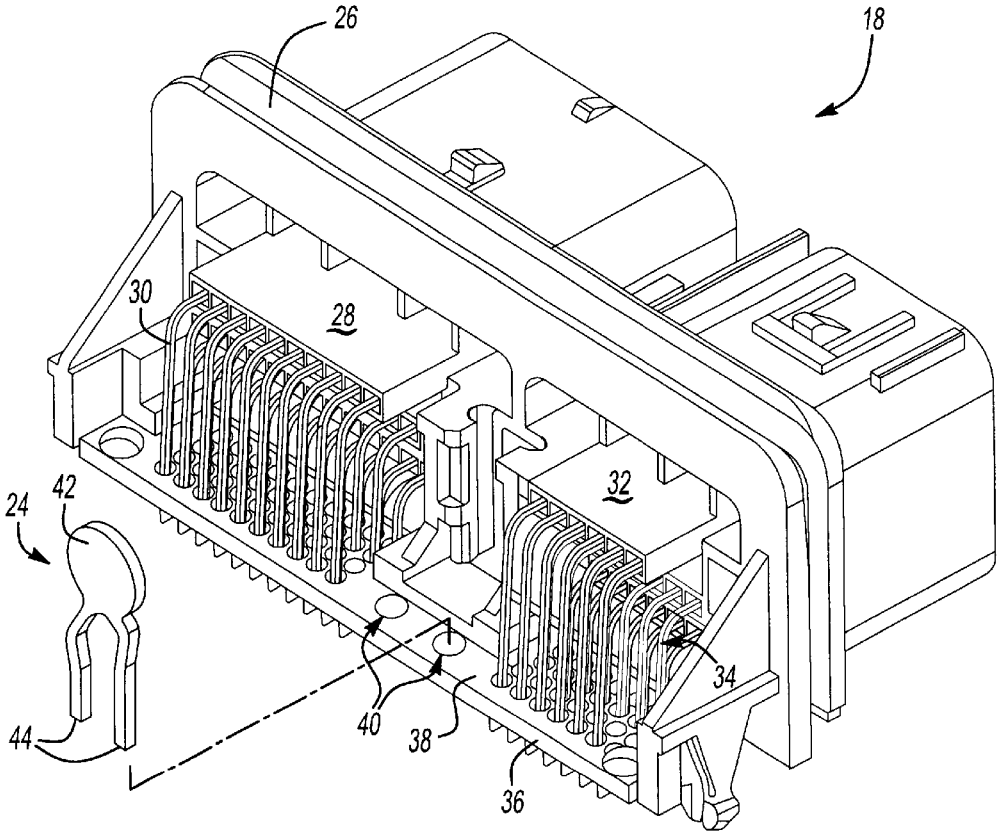
FIG. 2 is an exploded view of a connector assembly for the electronic control unit incorporating the subject invention.

As shown in FIG. 2, a metal oxide varistor (MOV) 24 is installed within the connector assembly 18 to divert current when operating voltages exceed a predetermined voltage limit. The MOV 24 can be installed within either the first 20 or second 22 connector.

The MOV 24 serves as a surge protection device to dissipate voltage surges or spikes in the connection, to ground. A surge protection device such as the MOV 24 forms a connection between a "hot" power line and a ground line. Typically a MOV 24 includes a piece of metal oxide material in the middle and is joined to the power and grounding lines by a pair of semiconductors.

The semiconductors have a variable resistance that is dependent on voltage. When voltage is below a certain level, the electrons in the semiconductors flow in such a way as to create a very high resistance. When the voltage exceeds that level, the behavior of the electrons is modified to create a lower resistance. When the operating voltage is normal, the MOV 24 does nothing. When the voltage surges or spikes, the MOV 24 operates to conduct a significant portion of current to eliminate or reduce the extra voltage.

Once the extra current is diverted through the MOV 24 to ground, the voltage returns to a normal operating level and the resistance of the MOV 24 returns to the high level. Thus, the MOV 24 only diverts the surge current while still allowing the standard current to continue powering the respective vehicle device 16.

The first 20 and second 22 connectors of the connector assembly 18 each include a housing portion 26. The housing portion 26 includes a first support structure 28 for a first plurality of leads 30 and a second support structure 32 for a second plurality of leads 34. The first 28 and second 32 support structures are preferably spaced apart from one another be a predetermined distance that depends on the number and types of leads 30, 34 used in the connector assembly 18. A base 36 of the housing portion 26 includes a mount interface 38 for attachment of the MOV 24. The mount interface 38 is located between the first 28 and second 32 support structures.

The mount interface 38 preferably includes a pair of holes 40 that are pre-formed in the base 36. The holes 40 are centrally located within the housing portion 26 at approximately an equal distance from the first 30 and second 34 plurality of leads.

Figure 3:
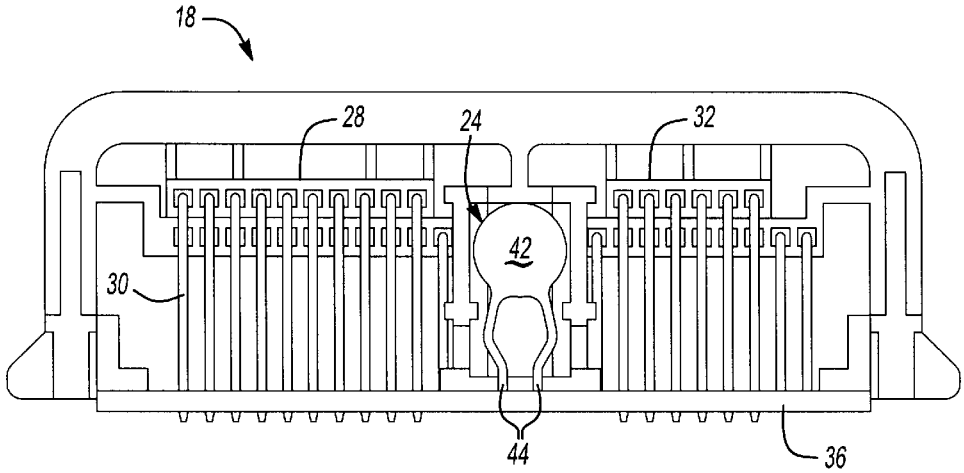
FIG. 3 is a front view of the assembly of FIG. 2 showing the metal oxide varistor in an installed position.

The MOV 24 includes a central body portion 42 with a pair of transversely extending legs 44. The legs 44 are received within the holes 40 to directly mount the MOV 24 to the housing portion 26. Once the legs 44 are inserted into the holes 40 and the first 20 and second 22 connectors are mated together, the MOV 24 and connectors 20, 22 are soldered together to form a secure connection between the ECU 10 and the vehicle device 16. The soldering process is well known in the art and thus will not be discussed in detail. An assembled MOV 24 in the connector housing portion 26 is shown in FIG. 3.

Mounting the MOV 24 directly within the connector assembly 18 removes the MOV from is traditional position on the PCB 14 and allows the overall size of the PCB 14 to be reduced, or optionally, frees up additional space on the PCB 14 for other components. By placing the MOV 24 in the connector assembly 18, a space savings of more than 80 square millimeters has been realized on the top side of the PCB 14 and a space savings of approximately 400 square millimeters has been realized on the solder side of the PCB 14.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A connector assembly for connecting a printed circuit board to a vehicle device comprising:

a first connector cooperating with a printed circuit board;

a second connector cooperating with a vehicle device wherein said first and second connectors mateably engage each other to electrically connect the printed circuit board and the vehicle device wherein said first and second connectors each include a connector housing for substantially enclosing a plurality of leads with at least one of said connector housings including a base that defines a mount interface; and a metal oxide varistor mounted within one of said first or second connectors for diverting current when operating voltages exceed a predetermined voltage limit wherein said metal oxide varistor directly engages said base of said first or second connector housings.

2. An assembly as set forth in claim 1 wherein said mount interface comprises at least two holes formed within said base of said connector housing and wherein said metal oxide varistor includes a pair of legs partially received within said holes.

3. An assembly as set forth in claim 2 wherein said holes are centrally positioned within said housing.

4. An assembly as set forth in claim 2 wherein said connector housing includes a first lead support structure and a second lead support structure separated from said first lead support structure by a predetermined distance with said mount interface being positioned between said first and second lead support structures.

5. An assembly as set forth in claim 1 wherein said connector housing includes a first support structure for a first plurality of leads and a second support structure for a second plurality of leads, said second support structure being laterally spaced apart from said first support structure along said base to define a gap, and wherein said mount interface is formed within said base between said first and second support structures with said metal oxide varistor being inserted directly into said mount interface such that said metal oxide varistor is centrally positioned within said gap between said first and second plurality of leads.

6. An assembly as set forth in claim 1 wherein said metal oxide varistor comprises a single metal oxide varistor solely supported by said base and enclosed within said connector housing.

7. A method for connecting an electronic control unit with surge protection to a vehicle device comprising the steps of:

(a) providing a connector assembly having a first connector cooperating with a printed circuit board and a second connector cooperating with a vehicle device, said first and second connectors each including a connector housing portion for substantially enclosing a plurality of leads;

(b) installing a metal oxide varistor within the first or second connector by inserting the metal oxide varistor directly into a base of one of the connector housing portions;

(c) mating the first and second connectors together to electrically connect the vehicle device and electronic control unit together; and (d) diverting current with the metal oxide varistor when operating voltages exceed a predetermined voltage limit.

8. A method as set forth in claim 7 including the step of soldering the metal oxide varistor and first and second connectors together for secure attachment to each other.

9. A method as set forth in claim 7 including the steps of forming a pair of holes within the base of the connector housing portion, forming the metal oxide varistor with a pair of legs, and inserting the legs into the holes.

10. A method as set forth in claim 9 including the steps of providing the connector housing portion with a first support structure for a first plurality of leads and a second support structure for a second plurality of leads with the second support structure being laterally spaced apart from the first support structure along said base to define a gap; forming the holes within the base between the first and second support structures; and inserting the legs directly into the holes such that the metal oxide varistor is centrally positioned within the gap between the first and second plurality of leads.

11. A method as set forth in claim 7 wherein the metal oxide varistor comprises a single metal oxide varistor and step (b) further includes solely supporting the single metal oxide varistor on the base and step (c) further includes enclosing the metal oxide varistor within the connector housing portions.

12. An electronic control unit for controlling a vehicle device assembly comprising:

an electronic control unit housing;

a printed circuit board enclosed within said electronic control unit housing;

a first connector cooperating with said printed circuit bard;

a second connector in mating engagement with said first connector to connect said printed circuit board to a vehicle device, said first and second connectors each including a connector housing portion for substantially enclosing a plurality of leads and wherein one of said housing portions includes a base; and at least one metal oxide varistor in direct engagement with said base for diverting current when operating voltages exceed a predetermined voltage limit.

13. An electronic control unit as set forth in claim 12 wherein said metal oxide varistor provides the sole surge protection for the vehicle device.

14. An electronic control unit as set forth in claim 12 wherein said metal oxide varistor includes a circular body portion and a pair of legs and wherein said base of said connector housing portion includes a pair of holes for receiving said pair of legs.

15. An electronic control unit as set forth in claim 14 wherein said pair of holes is centrally positioned within said connector housing portion.

16. An electronic control unit as set forth in claim 15 wherein said connector housing portion includes a first support structure for a first plurality of leads and a second support structure for a second plurality of leads, said second support structure being laterally spaced apart from said first support structure along said base to define a gap, and wherein said holes are pre-formed within said base between said first and second support structures with said legs being inserted directly through said holes such that said metal oxide varistor is centrally positioned within said gap between said first and second plurality of leads.

17. An electronic control unit as set forth in claim 16 wherein said at least one metal oxide varistor comprises a single metal oxide varistor supported solely by said base.

* * * * *